United States Patent [19]

Wolff et al.

[11] 4,369,101

[45] Jan. 18, 1983

[54] APPARATUS FOR ELECTROPOLISHING TUBES

[75] Inventors: Willi Wolff, Kahl; Ottomar Pfahls, Gelnhausen; Reinhold Schumacher, Babenhausen, all of Fed. Rep. of Germany

[73] Assignee: Nukem GmbH, Hanau, Fed. Rep. of Germany

[21] Appl. No.: 258,576

[22] Filed: Apr. 29, 1981

[30] Foreign Application Priority Data

May 2, 1980 [DE] Fed. Rep. of Germany ..... 3016795

[51] Int. Cl.[3] ..... C25F 7/00; C25D 17/00

[52] U.S. Cl. ..... 204/224 R; 204/225; 204/237; 204/272; 204/275

[58] Field of Search ..... 204/224 R, 225, 272, 204/275, 129.6, 129.7, 237

[56] References Cited

U.S. PATENT DOCUMENTS

| | | | |
|---|---|---|---|
| 2,764,540 | 9/1956 | Farin et al. | 204/272 X |
| 2,859,157 | 11/1958 | Curtiss, Jr. | 204/224 R X |
| 3,202,598 | 8/1965 | Covington et al. | 204/129.6 X |
| 3,506,557 | 4/1970 | Wentzell | 204/237 X |
| 3,533,926 | 10/1970 | Zubak et al. | 204/129.7 X |
| 3,720,595 | 3/1973 | Kohler | 204/272 X |
| 3,974,042 | 8/1976 | Angelini | 204/224 R X |

*Primary Examiner*—Donald R. Valentine

*Attorney, Agent, or Firm*—Cushman, Darby & Cushman

[57] ABSTRACT

Tubes, especially nuclear fuel element jacket tubes, in many cases must be polished internally as well as externally. Previously there was not a satisfactory process for doing this. An electropolishing process for the inner surface of tubes for achieving uniform polishing is desirable. This is accomplished with apparatus in which a metal lance is inserted into the tube being treated. Insulating spacers at the point of the lance and rearwardly thereof from a cathode therebetween spaced uniformly from the inner surface of the tube. Electrolyte flows through such space and preferably is supplied from the interior of the lance.

4 Claims, 3 Drawing Figures

APPARATUS FOR ELECTROPOLISHING TUBES

BACKGROUND OF THE INVENTION

The invention is directed to an apparatus for the electropolishing of the inner surfaces of metallic tubes.

The process of electropolishing has been known for many years but it is only recently that it has matured into industrial usage. By electrolytic removal of material from metal surfaces which are connected as the anode in an electrolyte there is obtained a very smooth, clean, semi-polished surface condition.

The electropolishing process finds widespread use in the production of polished metallic samples where a high surface quality is required. However, it also is used industrially for the production of very valuable semifinished products. Thus, for example, nuclear fuel element jacket tubes are electropolished externally after they are loaded with fuel and welded closed. A corresponding quality also is required for the tube inner surface. However, previous attempts to polish the inner surface of tubes electrolytically have led to unsatisfactory results. Uniformity of the surface quality was achieved and made reproducible only with great difficulty. Hence, to improve the tube inner surface quality, one resorted to the known processes of etching or sanding with air.

These known operating processes for polishing the inner surfaces of tubes have great disadvantages both economically and also ecologically. They require a high expenditure of manpower, a high consumption of etching solution and accordingly a high expense for processing or for conditioning waste solutions. Furthermore, there results a great amount of dust with air sanding and that process obtains only a non-uniform, difficultly reproducible surface area quality of the tube inner surfaces.

Therefore it was the problem solved by the present invention to produce apparatus for the electropolishing of the inner surfaces of a tube with which there can be produced a uniform polishing.

SUMMARY OF THE INVENTION

The problem solved by the invention includes a lance which is inserted into the tube. The lance has a region rearwardly of its point formed as metal cathode. The lance point and the rearward end of the region are provided with spacers to center the lance in the tube to assure a uniform dimension for the annular space in which electrolyte flows between the cathode region and the surrounding tube. Such flow of electrolyte is provided from within the lance which is tubular and preferably has outlets in the rear spacer facing the point. Such flow cools the cathode.

It has proven particularly advantageous to simultaneously immerse the tube in the electrolyte which has a tubular cathode for polishing of the outer surface of the tube. Thus, the inner and outer surfaces of the tube can be polished in a single operation.

DETAILED DESCRIPTION OF THE INVENTION

Figure 1:
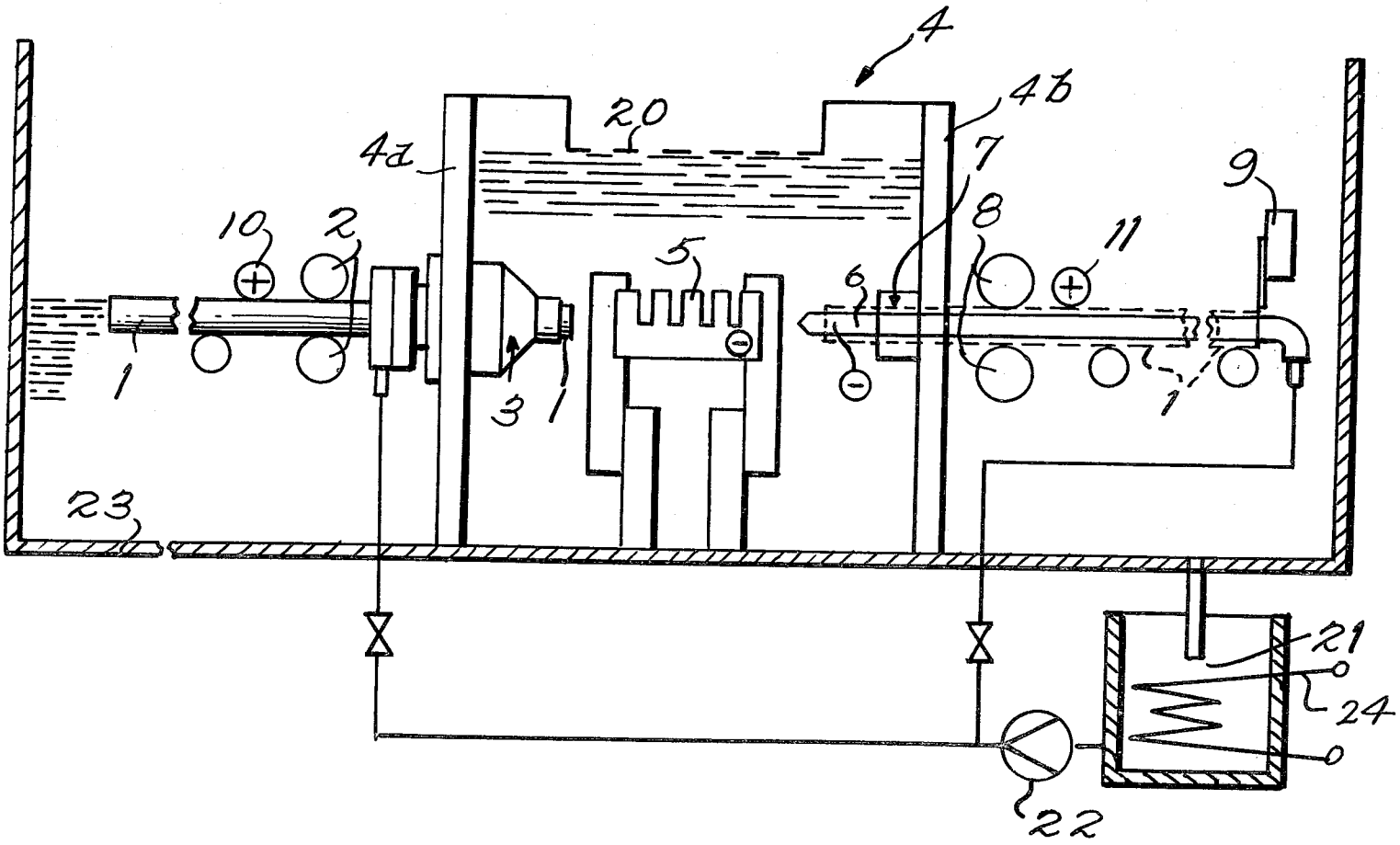
FIG. 1 is a schematic view of one form of apparatus according to the invention.
Figure 2:
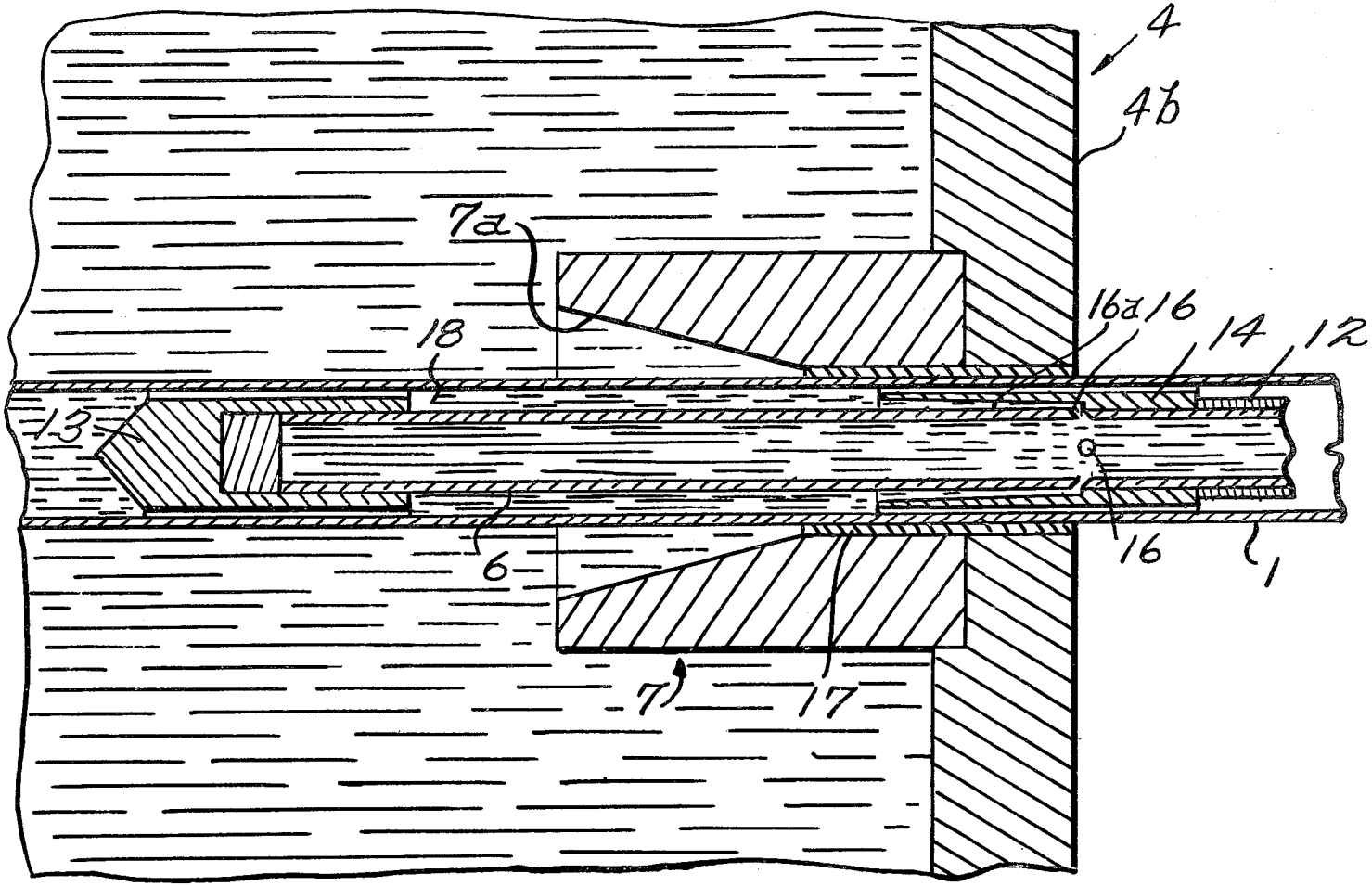
FIGS. 2 and 3 are enlarged fragmentary sectional views of the apparatus shown in FIG. 1.
Figure 3:
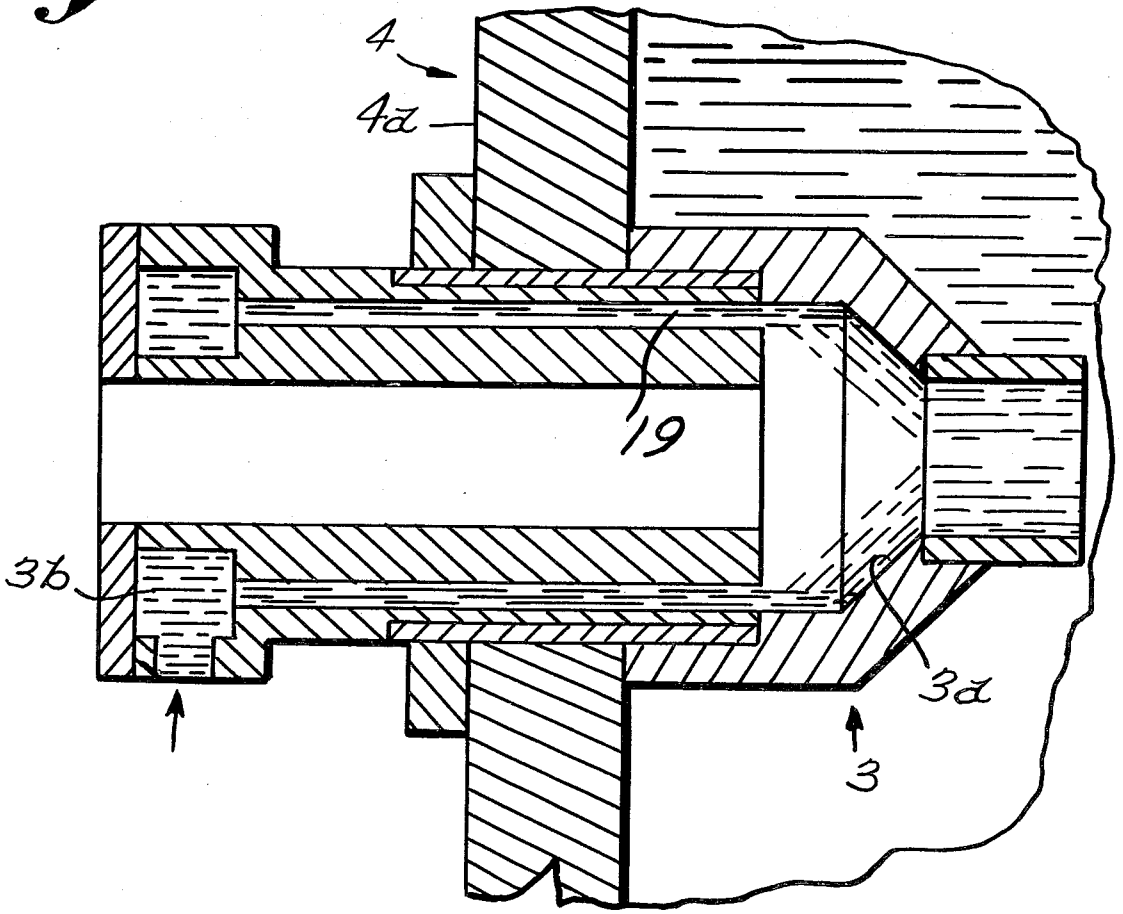

Referring more specifically to the drawings, a tube 1 to be treated is inserted and pushed by two conveying rolls 2 through a tube entrance jet 3 in a side wall 4*a* of an electrolysis cell 4 containing a electrolyte. Preferably, a conventional tubular cathode 5 is positioned in the cell 4 to receive and electrolytically polish the outer surface of the tube 1 during its passage through the cell. After passage through the tubular cathode 5, the tube 1 leaves the cell 4 through a tube exit jet 7 in the cell wall 4*b* opposite the wall 4*a*. This jet 7 is provided with an electrically-insulating tubular seal 17 which closely engages the outer surface of the tube 1, and preferably with an inwardly diverging conical surface 7*a* to facilitate passage of the tube 1 therethrough.

The exit of the tube 1 from the cell 4 is accomplished by a pair of exterior conveying rolls 8. A switch 9 may be positioned to be engaged by the tube 1 after traversing the cell 4 to reverse the conveying rolls 2 and 8 and transport the tube 1 back through the cell 4 and to electrolytically polish the tube again externally and internally, as later explained. Electric contact rolls 10 and 11 bearing against the outer surface of the tube 1 exterior on opposite sides of the cell 4 provide for the continuous electrical connection of the tube 1 with the positive pole of a source of electric power.

Projecting coaxially into and through the exit jet 7 is a tubular metal lance 6 closed at its inner end by a tapered point 13 of electrically insulating material. The point 13 is of spider-like or exteriorly grooved construction and has an outer diameter only slightly less than that of the interior diameter of the tube 1 so that when the tube is pushed over the lance by the rolls 2, the lance 6 is centered within the tube. Rearwardly of the point 13 and generally within the jet 7, the lance 6 is provided with another electrically insulating spacer 14 having an overall diameter about the same as or only slightly less than the interior diameter of the tube 1 so as to center the lance 6 in the tube 1 at the location of the spacer 14. Rearwardly of the spacer 14, i.e., exteriorly of the cell 4, the lance 6 is provided with a sleeve of electrical insulation 12 to prevent electrical contact of the lance, rearwardly of the spacer 14, with the tube 1. The outer end of the lance 6 is appropriately supported and connected to an appropriate source of electrical energy so that the lance will form a cathode, as later described.

At its outer end, the lance 6 is connected to a pump 22 which receives liquid electrolyte and pumps it into the lance 6. Within the spacer 14, the lance is provided with a plurality of forwardly inclined radial openings 16 which communicate with an interior enlargement 16*a* in the forward end of the spacer 16 so that the electrolyte will flow forwardly out of the enlargement toward the point 13 of the lance. Between the two electrically-insulating spacers 13 and 14, the lance forms a cathode along which the electrolyte flows in an annular space 18 of uniform radial dimension between the outer surface of the lance 6 and the inner surface of the tube 1. This assures uniform polishing of the interior surface of the tube 1 as it traverses this cathode.

Leakage of the electrolyte liquid out of the cell 4 through the tube entrance jet 3 is prevented by the constant introduction inwardly through that jet of liquid electrolyte at a pressure and velocity sufficient to prevent outflow of the electrolyte. For this purpose, the entrance jet 3 is provided, an inwardly converging interior conical surface 3a against which liquid electrolyte is directed from longitudinal bores 19 in a sleeve-like section of the jet 3 which communicate, exteriorly of the wall 4a with an annular manifold 3b connected to a pressurized source of the electrolyte, e.g., the pump 22. Similarly, leakage of liquid electrolyte out of the cell structure 4 through the exit jet 7 when no tube is present is prevented or minimized by the flow of electrolyte out of the annular engagement 16a in the inner or forward end of the spacer 14 on the lance 6.

The correct level of electrolyte in the cell 4 is maintained by a large overflow weir 20. Preferably, the cell 4, as well as the conveying rolls 2 and 8, are located within a trough or container 23 so that the electrolyte overflowing the weir 20 and flowing out of a tube 1 being treated, or possibly out of the entrance and exit jets 3 and 7 when no tube is present will be collected and drained into a collecting tank 21 which serves to supply the pump 22. A constant desired temperature of the electrolyte in the cell can be maintained by cooling coil 24 in the tank 21.

The surface treatment and the surface quality obtained with the apparatus of the invention are explained in more detail in the following examples where unless otherwise indicated all parts and percentages are by weight:

EXAMPLE 1

Electropolishing of the Inner Walls of Tubes

Material: Zircaloy, diameter, outer 10.5 mm and inner 9.6 mm.
Tube length: 3500 mm
Electrolyte:
10% perchloric acid
70% acetic acid
20% water
Pushing forward or back: 3 meters/min.
Voltage (V.) 11 volts, current (I.) 35 amperes
Electrolyte-throughput:
Inner Cathode: 4.5 l/min.
Inlet nozzle: 7.0 l/min.
Temperature: 25° C.
Measurement of the inner cathode: diameter 6 mm, length 120 mm
Results:
Number of tubes investigated: 10
Weight loss after electropolishing:
Average value: 2.121 grams
Standard deviation: 0.158 grams
From the weight loss there was calculated the material removed on the inner wall:
Average value: 3.09 microns
Standard deviation: 0.23 micron
Depth of roughness: 0.06 micron (Initial quality: 0.4 micron)

EXAMPLE 2

Electropolishing of Inner and Outer Walls of Tubes

Material: Zircaloy, diameter: outer 10.5 mm and inner 9.6 mm
Tube length: 3500 mm
Electrolyte:
10% perchloric acid
70% acetic acid
20% water
Pushing forward or back: 3 meters/min
Conditions for Inner Walls: Identical with Example 1
Conditions for Outer Walls: voltage ($U_2$) 16 volts, current ($I_2$) 44 amperes, current ($I_3$) 79 amperes
Measurements of the Outer Cathode:
Outer diameter: 40 mm
Inner diameter: 20 mm
Length: 100 mm
Results:
Number of tubes investigated: 10
Weight loss after electropolishing:
Average value 3.829 grams
Standard deviation 0.302 gra
Depth of roughness:
inner: 0.06 micron (previously 0.4 micron)
outer: 0.06 micron (previously 0.25 micron)
With the help of the results from Example 1 calculated for the outer wall:
Weight loss: 3.829-2=1.708 grams
Average material removed 2, 2.7 microns
Standard deviation: 0.40 micron (for material removed internally and externally)

The entire disclosure of the German priority application P No. 30 16795.4-45 is hereby incorporated by reference.

What is claimed is:

1. Apparatus for electropolishing the inner surface of a metallic tube comprising:

a metallic lance adapted to be inserted in the tube;

at least two electrically insulating spacer elements mounted on said lance in longitudinally spaced relation therealong, with the exposed surface of said lance between said elements constituting a metal cathode, said elements being of an overall dimension about the same as that of the interior diameter of the tube so that said elements serve to center said lance, and particularly said cathode, within said tube, the forward one of said elements being constructed to provide passageways therethrough for the out flow of electrolyte from the annular space between said cathode and the tube, and the rearward one of said elements and said lance being provided with passageways therethrough for flow of electrolyte from within said lance through said passageways and out of said rearward element forwardly toward said forward spacer element;

means connected to said lance rearwardly of said rearward element for supplying said lance passageway with liquid electrolyte a cell for containing liquid electrolyte with said lance projecting through a tube exit opening in the side wall of said cell with said rearward spacer element located substantially within said opening in closely spaced relation therewith;

a tubular structure projecting from said wall interiorly of said cell forwardly of said rearward spacer element whereby the flow of liquid electrolyte therefrom minimizes or prevents flow of electrolyte out of said cell through said exit opening when no tube is present;

means defining a tube entrance opening in the side wall of said cell opposite said exit opening; and means for minimizing or preventing flow of electrolyte out of said entrance opening when no tube is present comprising means for directing a jet-like flow of electrolyte into said entrance opening.

2. The apparatus according to claim 1 including a tubular shaped cathode located in the cell for passage therethrough of the tube to be treated to electrolytically polish the outer surface of the tube.

3. Apparatus according to claim 1 including:

a container wherein the cell is positioned to collect possible leakage of electrolyte from a tube being treated and from the entrance and exit structures; and means for collecting such liquid from the container and pumping it under pressure to the entrance structure and to the lance passage.

4. Apparatus according to claim 1 including conveyor means exterior of the cell in alignment with the entrance and exit openings for engaging a tube to be treated and pushing it through said entrance opening over the lance and out of the exit opening and then reversing movement of the tube to again traverse the cell and pass out of the entrance opening.

* * * * *